US006612832B1

(12) United States Patent
Huang

(10) Patent No.: US 6,612,832 B1
(45) Date of Patent: Sep. 2, 2003

(54) LIGHTER HAVING A TWO-STAGE LOCKING TYPE SAFETY SWITCH

(76) Inventor: Ying Fang Huang, No. 2, Lane 22, Sec. 2, Shanshi Rd., Bei Chu, Taichung (TW), 404

( * ) Notice: Subject to any disclaimer, the term of this patent is extended or adjusted under 35 U.S.C. 154(b) by 0 days.

(21) Appl. No.: 10/139,227

(22) Filed: May 7, 2002

(51) Int. Cl.[7] ..... F23Q 7/12; F23D 11/36

(52) U.S. Cl. ..... 431/153; 431/131; 431/132; 431/130

(58) Field of Search ..... 431/153, 129, 431/130, 131, 132, 133–141, 255

(56) References Cited

U.S. PATENT DOCUMENTS

| | | | | | |
|---|---|---|---|---|---|
| 2,283,909 | A | * | 5/1942 | Bolle | 431/134 |
| 2,701,459 | A | * | 2/1955 | Williams | 431/230 |
| 3,442,598 | A | * | 5/1969 | Halm | 431/255 |
| 5,310,336 | A | * | 5/1994 | Segawa | 431/131 |
| 5,531,591 | A | * | 7/1996 | Yamazaki | 431/153 |
| 6,135,761 | A | * | 10/2000 | Chen | 431/132 |
| 6,186,772 | B1 | * | 2/2001 | Huang | 431/132 |
| 6,231,335 | B1 | * | 5/2001 | Huang | 431/153 |
| 6,431,853 | B1 | * | 8/2002 | Sher | 431/153 |

FOREIGN PATENT DOCUMENTS

| | | | | |
|---|---|---|---|---|
| FR | 1030915 | * | 6/1953 | 431/134 |
| JP | 05-157235 | * | 6/1993 | 431/153 |

* cited by examiner

*Primary Examiner*—Carl D. Price
(74) *Attorney, Agent, or Firm*—Rosenberg, Klein & Lee

(57) ABSTRACT

A lighter having a two-stage locking type safety switch includes a press member pivotally mounted on the liquid gas container, a first-stage safety switch structure, and a second-stage safety switch structure. The first-stage safety switch structure includes a clutch structure mounted in the press cover, for controlling the press cover and the liquid gas container to be disposed at a first-stage locking or free state. The second-stage safety switch structure includes a locking recess formed in the guide slot of the top cover, so that the locking recess and the guide slot of the top cover may form a substantially L-shaped structure. Thus, the slide knob has to slide in the locking recess to move into the guide slot. Then, the slide knob may move in the guide slot to release the safety switch, thereby igniting the lighter.

14 Claims, 10 Drawing Sheets

LIGHTER HAVING A TWO-STAGE LOCKING TYPE SAFETY SWITCH

BACKGROUND OF THE INVENTION

1. Field of the Invention

The present invention relates to a lighter having a two-stage locking type safety switch, and more particularly to a lighter having a two-stage locking type safety switch, wherein the slide knob has to proceed a substantially L-shaped movement to trigger the igniter and light the lighter, so that the lighter cannot be operated easily and unintentionally, thereby providing a double safety effect.

2. Description of the Related Art

A conventional press arm type lighter in accordance with the prior art shown in FIGS. 1 and 2 comprises a liquid gas container 90, and a press arm 91 rotatably mounted on the top of the liquid gas container 90 and having a pivot arm 92 pivotally mounted in the liquid gas container 90. When the press arm 91 is pressed and rotated, the pivot arm 92 may be pivoted to open a gas open/close valve 93 and an igniter 94, so that the gas contained in the liquid gas container 90 may be conveyed to the opening of the liquid gas container 90, and may be ignited by the ignition coil 941. When the press arm 91 is returned to the original position to cover the opening of the liquid gas container 90, the gas open/close valve 93 may be closed, so as to shutoff conveyance of the gas contained in the liquid gas container 90, thereby distinguishing the lighter. However, the press arm 91 is easily pressed unintentionally to ignite the lighter, thereby easily causing danger to the user or the children.

A conventional press type lighter in accordance with the prior art is disclosed in the applicant's U.S. Pat. No. 6,186,772B1 and U.S. Pat. No. 6,231,335B1. However, the conventional press type lighter disclosed in the applicant's U.S. Pat. No. 6,231,335B1 has a complicated construction with many parts, thereby increasing costs of fabrication.

SUMMARY OF THE INVENTION

The present invention has arisen to mitigate and/or obviate the disadvantage of the conventional lighter.

The primary objective of the present invention is to provide a lighter having a two-stage locking type safety switch, wherein the slide knob has to proceed a substantially L-shaped movement to trigger the igniter and light the lighter, so that the lighter cannot be operated easily and unintentionally, thereby providing a double safety effect.

Another objective of the present invention is to provide a lighter having a two-stage locking type safety switch, wherein the lighter has a simple construction, thereby saving cost of fabrication.

In accordance with the present invention, there is provided a lighter having a two-stage locking type safety switch, comprising a liquid gas container, a press member pivotally mounted on the liquid gas container, and a first-stage safety switch structure including a clutch structure mounted in the press cover, for controlling the press cover and the liquid gas container to be disposed at a first-stage locking or free state.

The lighter having a two-stage locking type safety switch further comprises a second-stage safety switch structure mounted between the slide knob, the control member and the top cover, wherein the second-stage safety switch structure includes a locking recess formed in the guide slot of the top cover, so that the locking recess and the guide slot of the top cover may form a substantially L-shaped structure, and the slide knob may slide in the locking recess to move into the guide slot of the top cover.

Further benefits and advantages of the present invention will become apparent after a careful reading of the detailed description with appropriate reference to the accompanying drawings.

DETAILED DESCRIPTION OF THE INVENTION

Figure 1:
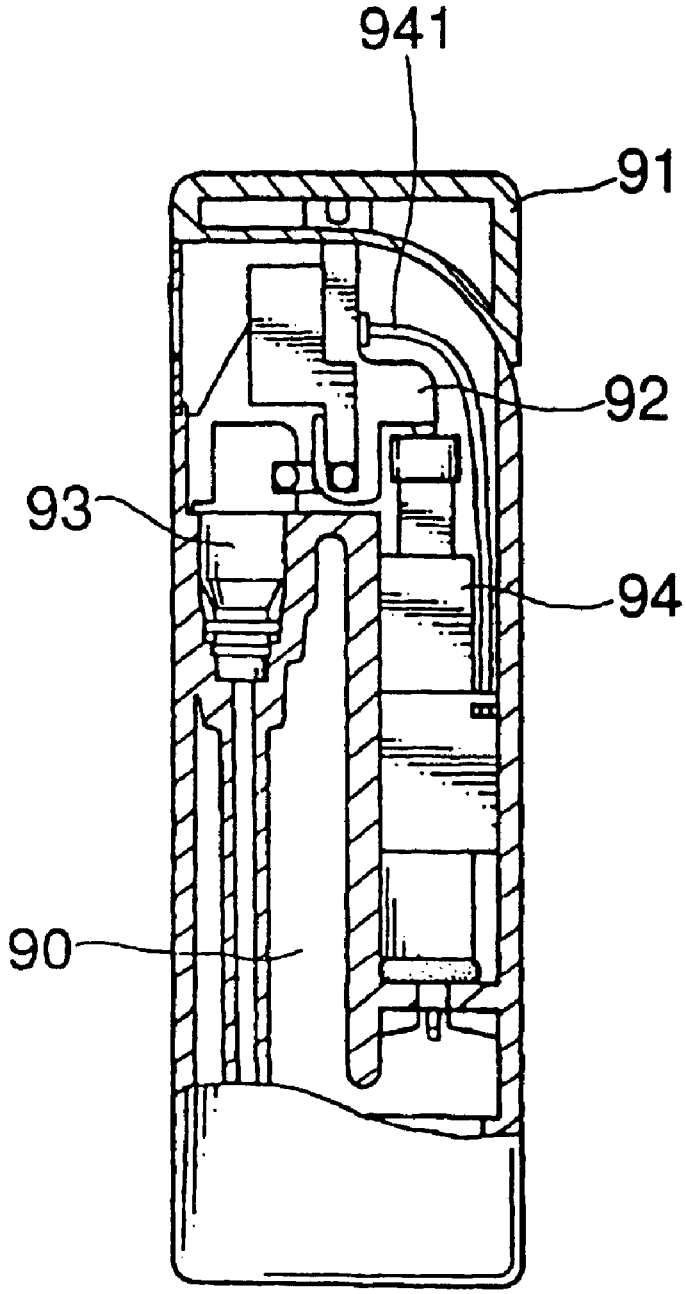
FIG. 1 (PRIOR ART)
FIG. 1 is a side plan cross-sectional assembly view of a conventional press arm type lighter in accordance with the prior art.
Figure 2:
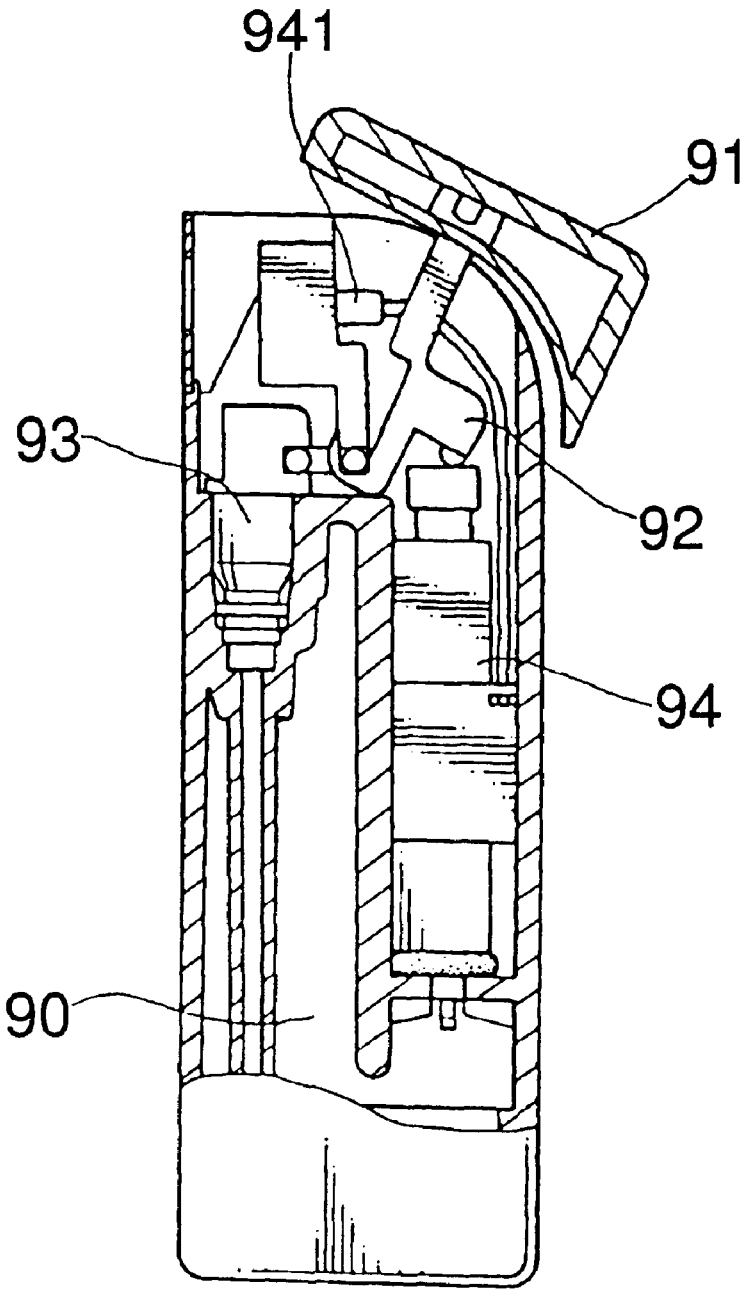
FIG. 2 (PRIOR ART)
FIG. 2 is a schematic operational view of the conventional press arm type lighter as shown in FIG. 1 in use.
Figure 3:
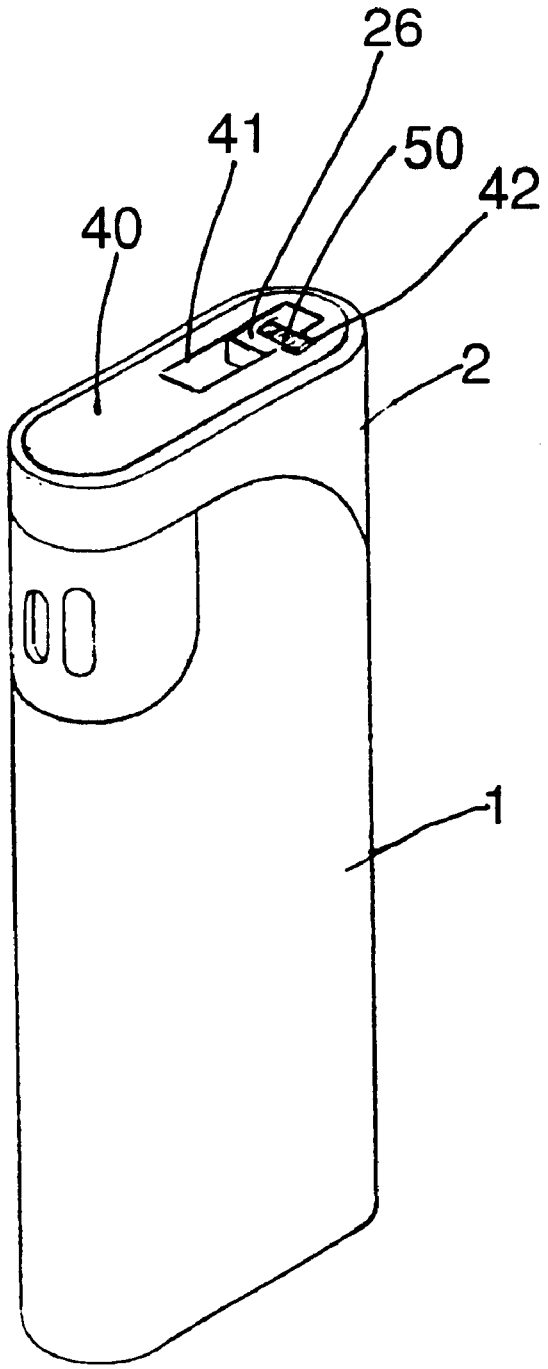
FIG. 3 is a perspective view of a lighter having a two-stage locking type safety switch in accordance with a preferred embodiment of the present invention.
Figure 4:
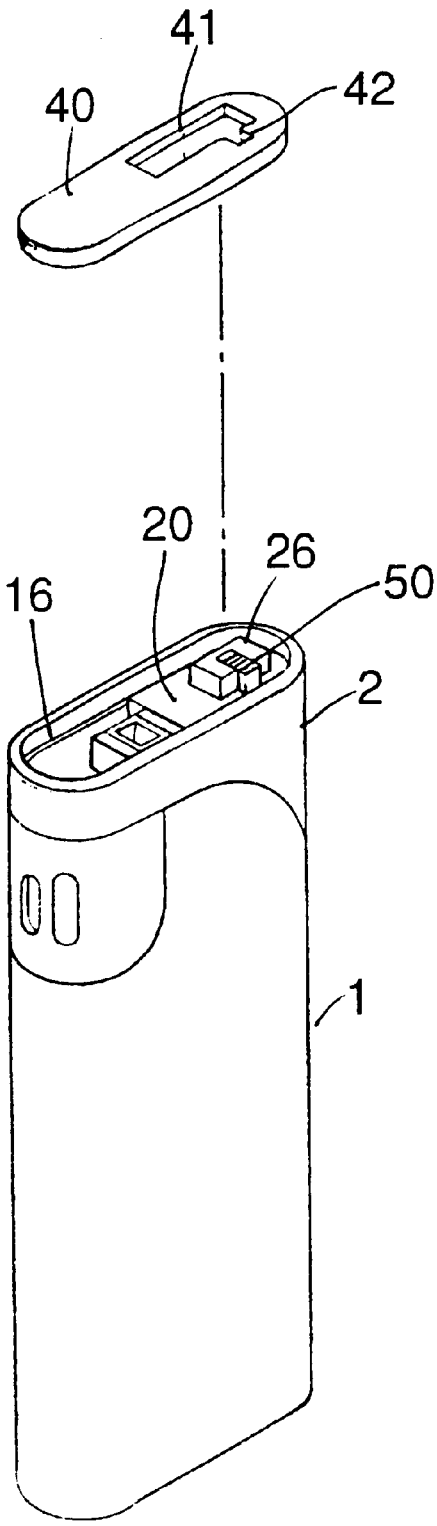
FIG. 4 is a partially exploded perspective view of the lighter having a two-stage locking type safety switch as shown in FIG. 3.
Figure 5:
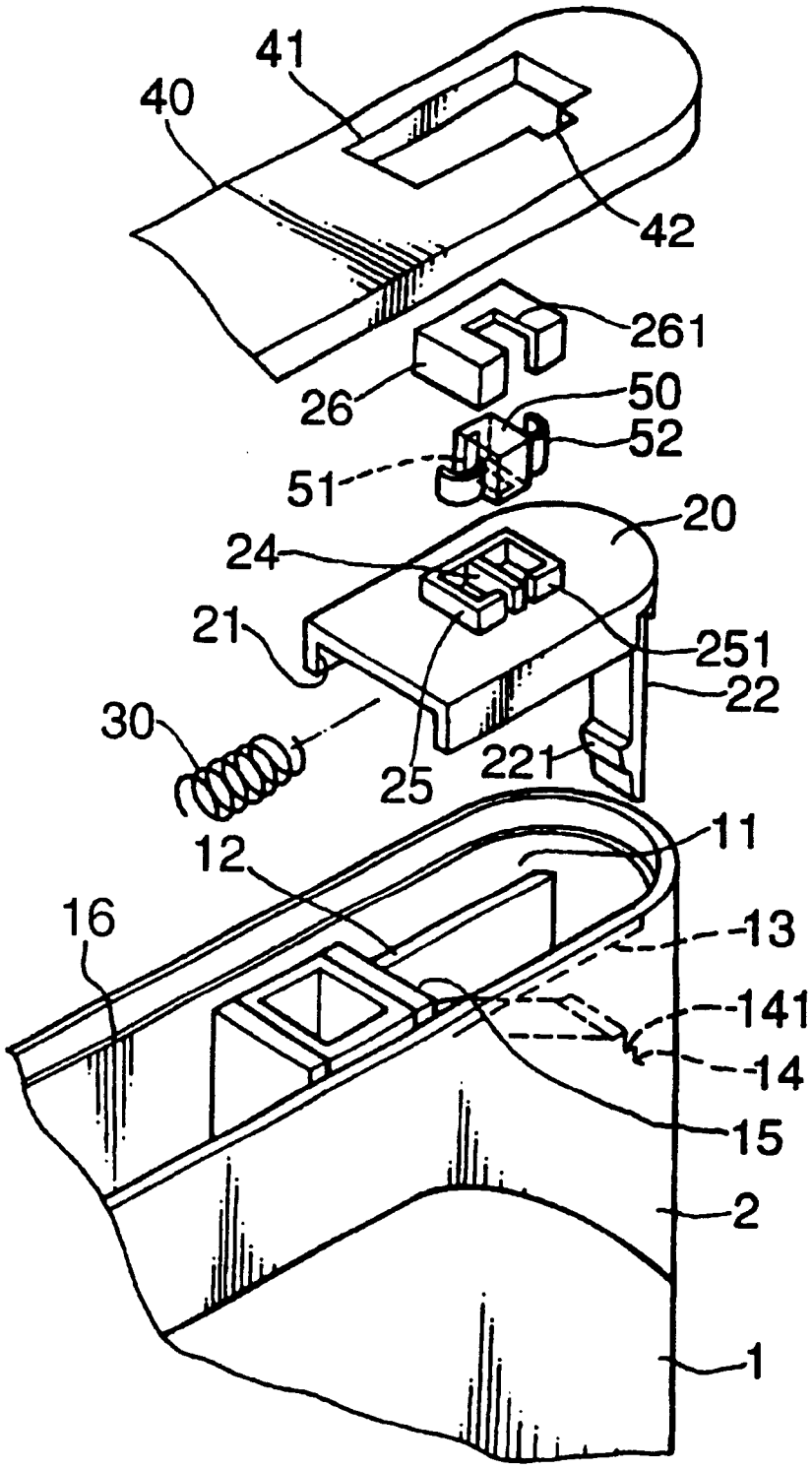
FIG. 5 is a partially cut-away exploded perspective view of the lighter having a two-stage locking type safety switch as shown in FIG. 3.

Referring to the drawings and initially to FIGS. 3–6, a lighter having a two-stage locking type safety switch in accordance with a preferred embodiment of the present invention comprises a liquid gas container 1, and a press cover 2 rotatably mounted on the top of the liquid gas container 1 and having a pivot arm 3 pivotally mounted in the liquid gas container 1. When the press cover 2 is pressed and rotated, the pivot arm 3 may be pivoted to open a gas open/close valve 4 and an igniter 5, so that the gas contained in the liquid gas container a may be conveyed to the opening of the liquid gas container 1, and may be ignited, thereby igniting the lighter. When the press cover 2 is returned to the original position to cover the opening of the liquid gas container 1, the gas open/close valve 4 may be closed, so as to shutoff conveyance of the gas contained in the liquid gas container 1, thereby distinguishing the lighter.

The lighter having a two-stage locking type safety switch in accordance with the preferred embodiment of the present invention further comprises a clutch structure mounted in the press cover 2, for controlling the press cover 2 and the liquid gas container 1 to be disposed at a first-stage locking or free state.

The clutch structure includes a receiving chamber 11 having a substantially V-shaped cross-section formed in the press cover 2. The receiving chamber 11 is provided with two spaced guide rails 12 and 13. The receiving chamber 11 is formed with a through hole 14 which is located between the two spaced guide rails 12 and 13 and faces a top edge of an inner side wall of the liquid gas container 1.

A control member 20 is slidably mounted on the two spaced guide rails 12 and 13 of the receiving chamber 11. The control member 20 is provided with an inverted U-shaped guide track 21 mounted on the two spaced guide rails 12 and 13 of the receiving chamber 11, so that the control member 20 may be moved linearly on the two spaced guide rails 12 and 13 of the receiving chamber 11.

The control member 20 is provided with an elastic arm 22 which has a bottom end extended through the through hole 14 and rested on the top edge of the inner side wall of the liquid gas container 1, so that the press cover 2 and the liquid gas container 1 are disposed at a locked state actually. The bottom of the control member 20 is provided with a catch plate 23 (see FIG. 6), and the receiving chamber 11 is provided with a catch plate 15, so that the catch plate 23 of the control member 20 and the catch plate 15 of the receiving chamber 11 may form a mounting space for mounting an elastic member 30 which may push the catch plate 23 of the control member 20 by its elastic force, so that the bottom of the elastic arm 22 of the control member 20 may be rested on the top edge of the inner side wall of the liquid-gas container 1 exactly, and the press cover 2 and the liquid gas container 1 may be disposed at a locked state actually.

In addition, the bottom of the elastic arm 22 of the control member 20 is provided with a reinforcing rib 221 which is received in an opened space 141 that is formed in the receiving chamber 11 and located above the through hole 14, so that the reinforcing rib 221 may enhance the entire strength of the elastic arm 22.

The top edge of the receiving chamber 11 is provided with a mounting shoulder 16, and a top cover 40 is mounted on the mounting shoulder 16, so that the control member 20 may be sealed in the receiving chamber 11.

A slide knob 50 is mounted on the top of the control member 20. The top cover 40 is formed with a guide slot 41, so that the slide knob 50 may slide linearly in the guide slot 41 of the top cover 40.

Figure 6:
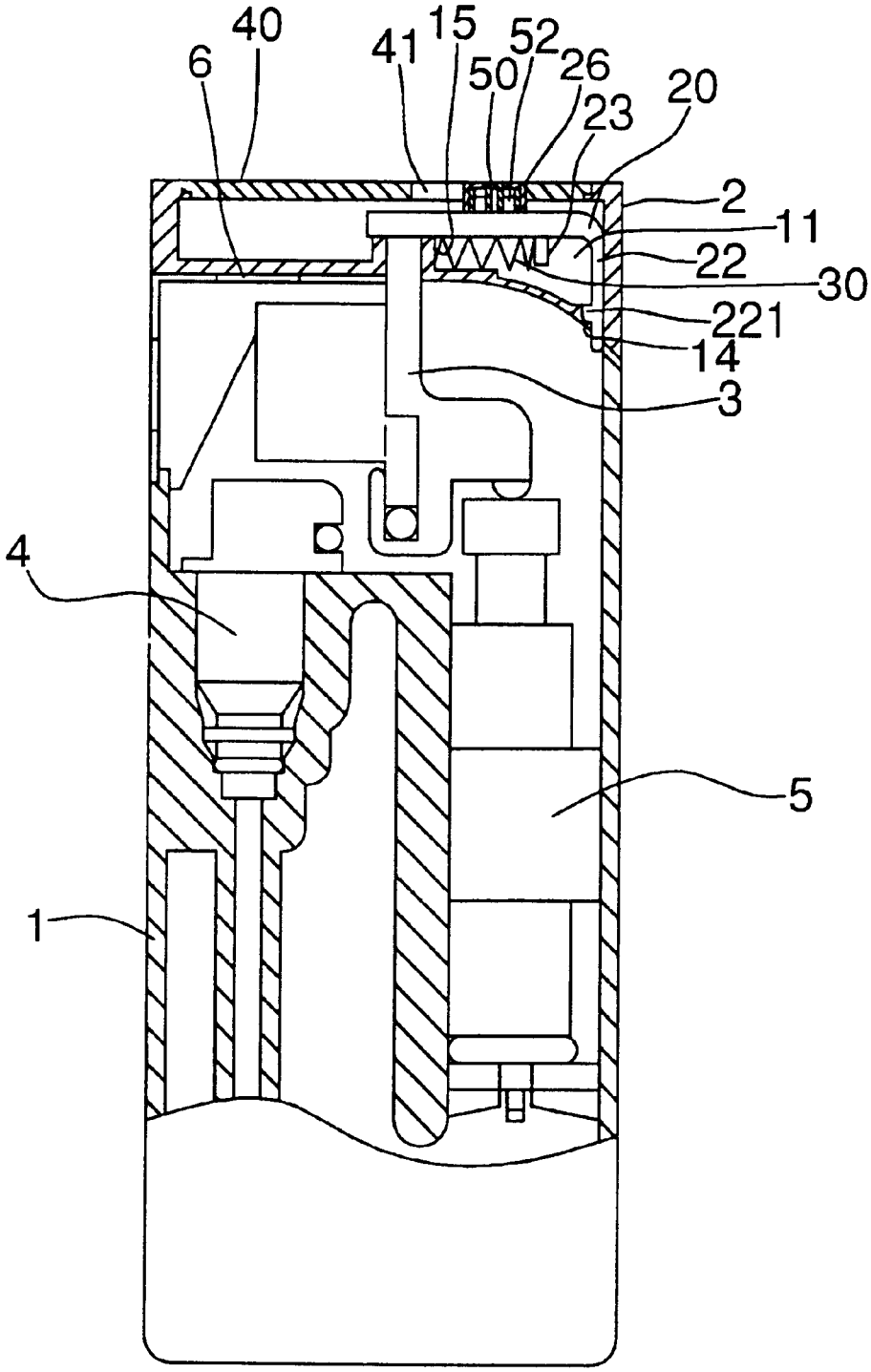
FIG. 6 is a side plan cross-sectional view of the lighter having a two-stage locking type safety switch as shown in FIG. 3.
Figure 10:
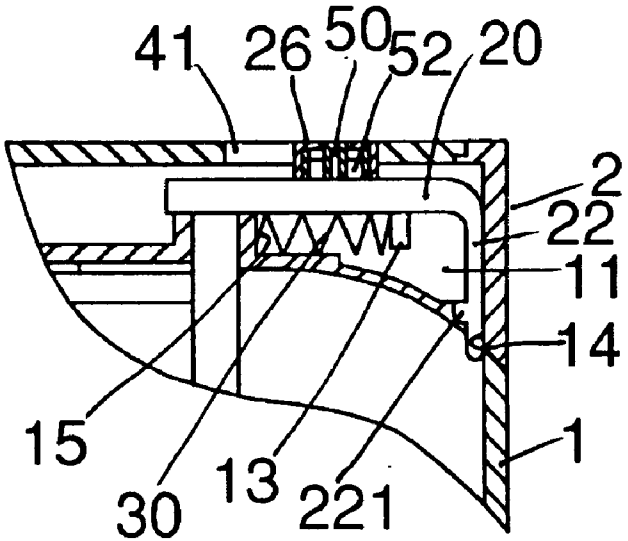
FIG. 10 is a schematic operational view of the lighter having a two-stage locking type safety switch as shown in FIG. 8 in use.

In operation, the bottom of the elastic arm 22 of the control member 20 is initially extended through the through hole 14 and rested on the top edge of the inner side wall of the liquid gas container 1 exactly as shown in FIGS. 6 and 10, so that the press cover 2 and the liquid gas container 1 may be disposed at a locked state actually.

Figure 9:
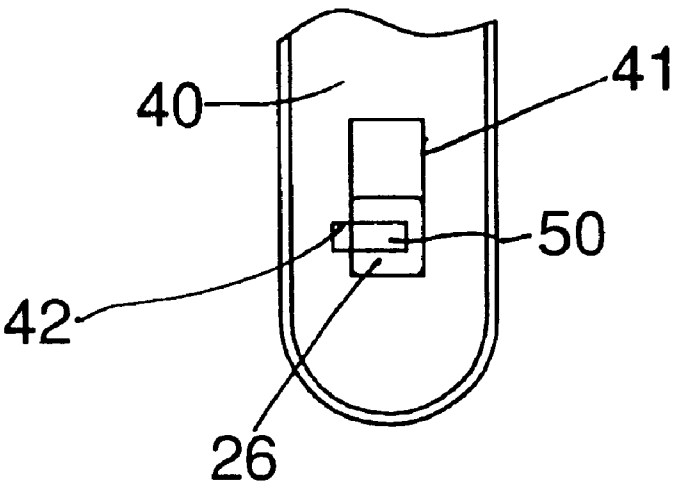
FIG. 9 is a schematic operational view of the lighter having a two-stage locking type safety switch as shown in FIG. 7 in use.
Figure 12:
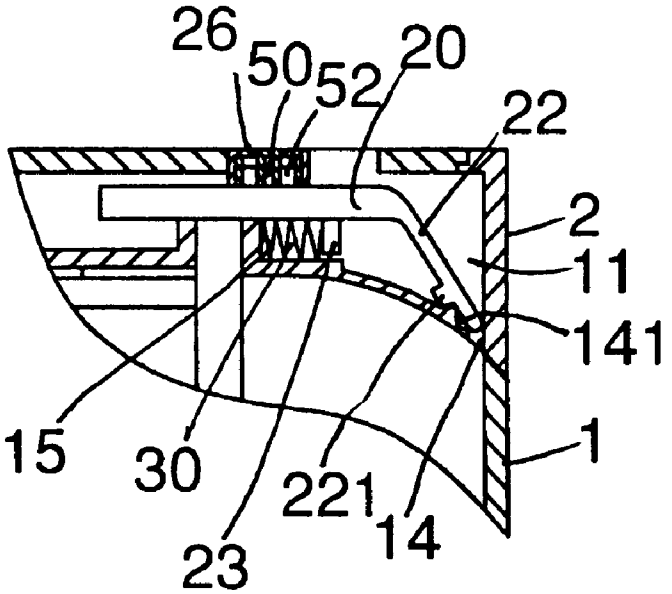
FIG. 12 is a schematic operational view of the lighter having a two-stage locking type safety switch as shown in FIG. 10 in use.
Figure 11:
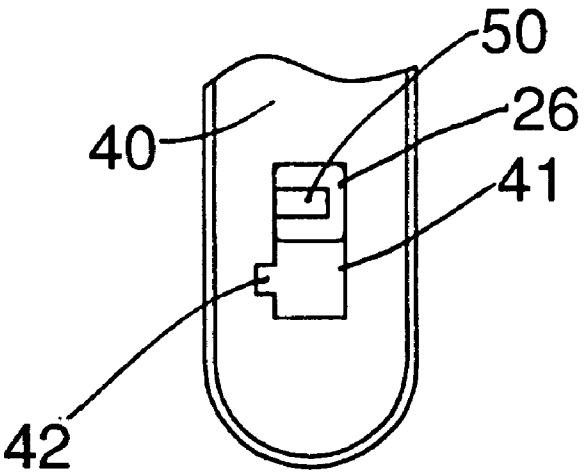
FIG. 11 is a schematic operational view of the lighter having a two-stage locking type safety switch as shown in FIG. 9 in use.
Figure 13:
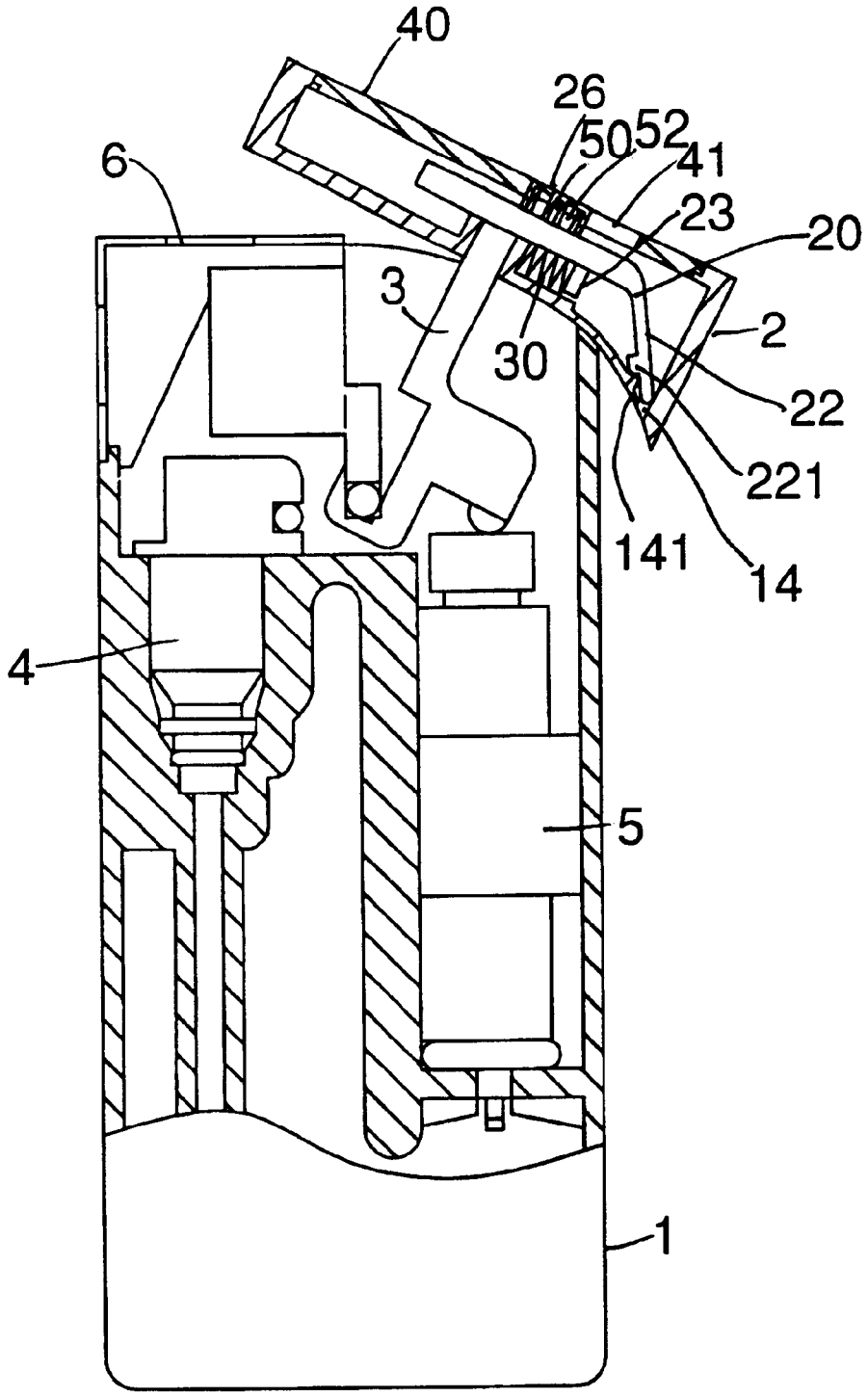
FIG. 13 is a schematic operational view of the lighter having a two-stage locking type safety switch as shown in FIG. 6 in use.

Then, the slide knob 50 may be pushed to overcome the elastic force of the elastic member 30 to slide in the guide slot 41 of the top cover 40 and to move from the position as shown in FIG. 9 to the position as shown in FIG. 11, so that the control member 20 and the elastic arm 22 may be moved from the position as shown in FIG. 10 to the position as shown in FIG. 12, thereby detaching the bottom of the elastic arm 22 of the control member 20 from the top edge of the inner side wall of the liquid gas container 1, so that the press cover 2 and the liquid gas container 1 may be disposed at a unlocked state. Thus, the press cover 2 may be pressed as shown in FIG. 13, to activate the gas open/close valve 4 and the igniter 5, thereby igniting the lighter.

Accordingly, the elastic arm 22 of the control member 20 and the through hole 14 of the press cover 2 may form the first-stage safety switch structure.

Again referring to FIG. 5, the press type lighter having a safety switch in accordance with the preferred embodiment of the present invention further comprises a second-stage safety switch structure mounted between the slide knob 50, the control member 20 and the top cover 40.

The second-stage safety switch structure includes a locking recess 42 formed in the guide slot 41 of the top cover 40, so that the locking recess 42 and the guide slot 41 of the top cover 40 may form a substantially L-shaped structure. The top of the control member 20 is provided with a locking rail 24. The slide knob 50 may slide in the locking recess 42, and has a bottom formed with a channel 51 for receiving the locking rail 24 of the control member 20, so that the slide knob 50 may slide in the locking recess 42 by guidance of the locking rail 24 of the control member 20 to move into the guide slot 41 of the top cover 40.

The top of the control member 20 is provided with a substantially inverted U-shaped positioning block 25 enclosed around the locking rail 24, for enhancing the stability of movement of the slide knob 50. The positioning block 25 has two distal ends each formed with a hook portion 251 located beside the locking rail 24. The control member 20 includes an inner cover 26 mounted on the positioning block 25 for covering the slide knob 50. The inner cover 26 is formed with a secondary channel 261. The slide knob 50 is protruded outward from the secondary channel 261 of the inner cover 26 into the locking recess 42.

The slide knob 50 has two sides each provided with a wing-shaped elastic member 52 which is rested on the positioning block 25, so that the slide knob 50 is pushed by the two wing-shaped elastic members 52 to move toward a direction away from the guide slot 41 of the top cover 40, thereby forming the second-stage safety switch structure.

Figure 8:
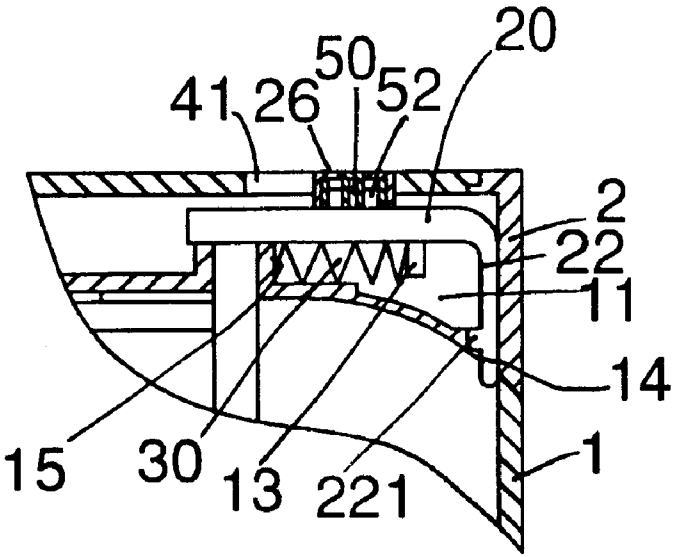
FIG. 8 is a partially cut-away view of the lighter having a two-stage locking type safety switch as shown in FIG. 6.
Figure 7:
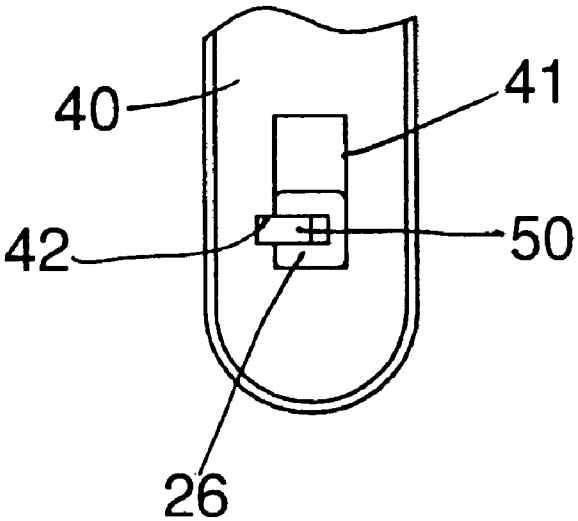
FIG. 7 is a top plan partially cut-away view of the lighter having a two-stage locking type safety switch as shown in FIG. 3.

In operation, the slide knob 50 is initially locked in the locking recess 42 as shown in FIGS. 7 and 8. Then, the slide knob 50 may be pushed to overcome the elastic force of the two wing-shaped elastic members 52 of the slide knob 50 to slide in the locking recess 42 and to move from the position as shown in FIG. 7 to the position as shown in FIG. 9 where the slide knob 50 is detached from the locking recess 42, so that the slide knob 50 may slide in the guide slot 41 of the top cover 40 freely.

At the same time, the bottom of the elastic arm 22 of the control member 20 is initially extended through the through hole 14 and rested on the top edge of the inner side wall of the liquid gas container 1 exactly as shown in FIGS. 6 and 10, so that the press cover 2 and the liquid gas container 1 may be disposed at a locked state actually.

Then, the slide knob 50 may be pushed to overcome the elastic force of the elastic member 30 to slide in the guide slot 41 of the top cover 40 and to move from the position as shown in FIG. 9 to the position as shown in FIG. 11, so that the control member 20 and the elastic arm 22 may be moved from the position as shown in FIG. 10 to the position as shown in FIG. 12, thereby detaching the bottom of the elastic arm 22 of the control member 20 from the top edge of the inner side wall of the liquid gas container 1, so that the press cover 2 and the liquid gas container 1 may be disposed at a unlocked state. Thus, the press cover 2 may be pressed as shown in FIG. 13, to activate the gas open/close valve 4 and the igniter 5, thereby igniting the lighter.

Accordingly, the second-stage safety switch structure is mounted between the slide knob 50, the control member 20 and the top cover 40, whereby the slide knob 50 has to proceed a substantially L-shaped movement to trigger the igniter 5 and ignite the lighter, so that the lighter cannot be operated easily and unintentionally, thereby providing a double safety effect. In addition, the lighter having a two-stage locking type safety switch in accordance with the present invention has a simple construction, thereby saving cost of fabrication.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A lighter having a two-stage locking type safety switch, comprising a liquid gas container, a press member pivotally mounted on the liquid gas container, and a first-stage safety switch structure including a clutch structure mounted in the press cover, for controlling the press cover and the liquid gas container;

the clutch structure including a receiving chamber formed in the press cover, the receiving chamber being formed with a through hole, a control member being slidably mounted in the receiving chamber, the control member having an elastic arm formed with a bottom portion extending into the through hole to engage a top edge of an inner side wall of the liquid gas container, the press cover and liquid gas container being thereby disposed in a locked configuration.

2. The lighter having a two-stage locking type safety switch in accordance with claim 1, wherein the receiving chamber is provided with two spaced guide rails, and the control member is slidably mounted on the two spaced guide rails of the receiving chamber.

3. The lighter having a two-stage locking type safety switch in accordance with claim 2, wherein the control member is provided with an inverted U-shaped guide track mounted on the two spaced guide rails of the receiving chamber, so that the control member may be moved linearly on the two spaced guide rails of the receiving chamber.

4. The lighter having a two-stage locking type safety switch in accordance with claim 1, wherein the control member is provided with a catch plate, and the receiving chamber is provided with a catch plate, so that the catch plate of the control member and the catch plate of the receiving chamber form a mounting space to receive an elastic member for biasing the catch plate of the control member, whereby the bottom of the elastic arm of the control member engages the top edge of the inner side wall of the liquid gas container.

5. The lighter having a two-stage locking type safety switch in accordance with claim 1, wherein the elastic arm of the control member is provided with a reinforcing rib received in an opened space formed in the receiving chamber above the through hole to augment the strength of the elastic arm.

6. The lighter having a two-stage locking type safety switch in accordance with claim 1, further comprising a top cover mounted on a top edge of the receiving chamber and formed with a guide slot, and a slide knob mounted on a top of the control member and slidably mounted in the guide slot of the top cover.

7. The lighter having a two-stage locking type safety switch in accordance with claim 6, wherein the top edge of the receiving chamber is provided with a mounting shoulder, and the top cover is mounted on the mounting shoulder, so that the control member may be sealed in the receiving chamber.

8. The lighter having a two-stage locking type safety switch in accordance with claim 6, further comprising a second-stage safety switch structure mounted between the slide knob, the control member and the top cover, wherein the second-stage safety switch structure includes a locking recess formed in the guide slot of the top cover, so that the locking recess and the guide slot of the top cover may form a substantially L-shaped structure, and the slide knob may slide in the locking recess to move into the guide slot of the top cover.

9. The lighter having a two-stage locking type safety switch in accordance with claim 8, wherein the top of the control member is provided with a locking rail, and the slide knob has a bottom formed with a channel for receiving the locking rail of the control member, so that the slide knob may slide in the locking recess by guidance of the locking rail of the control member to move into the guide slot of the top cover.

10. The lighter having a two-stage locking type safety switch in accordance with claim 9, wherein the top of the control member is provided with a substantially inverted U-shaped positioning block enclosed around the locking rail, for enhancing the stability of movement of the slide knob.

11. The lighter having a two-stage locking type safety switch in accordance with claim 10, wherein the positioning block has two distal ends each formed with a hook portion located beside the locking rail.

12. The lighter having a two-stage locking type safety switch in accordance with claim 10, wherein the control member includes an inner cover mounted on the positioning block for covering the slide knob.

13. The lighter having a two-stage locking type safety switch in accordance with claim 12, wherein the inner cover is formed with a secondary channel, and the slide knob is protruded outward from the secondary channel of the inner cover into the locking recess.

14. The lighter having a two-stage locking type safety switch in accordance with claim 10, wherein the slide knob has two sides each provided with a wing-shaped elastic member which is rested on the positioning block.

* * * * *